United States Patent [19]

Lynch et al.

[11] 3,945,565

[45] Mar. 23, 1976

[54] SYSTEM POWERED ACTUATING MEANS FOR BUTTERFLY TYPE DAMPER

[75] Inventors: John F. Lynch, Clarks Summit; William J. Waeldner, Waverly, both of Pa.

[73] Assignee: Anemostat Products Division Dynamics Corporation of America, Scranton, Pa.

[22] Filed: June 25, 1975

[21] Appl. No.: 590,059

[52] U.S. Cl. ..... 236/49; 137/489; 251/61; 92/39

[51] Int. Cl.[2] ..... F24F 7/00; F16K 31/165

[58] Field of Search ..... 236/13, 49, 92; 137/489; 251/61; 92/37, 39

[56] References Cited

UNITED STATES PATENTS

| | | | |
|---|---|---|---|
| 2,998,194 | 8/1961 | Curran et al. | 137/489 X |
| 3,361,157 | 1/1968 | Schach | 137/489 |
| 3,769,998 | 11/1973 | Avant | 137/489 |
| 3,804,364 | 4/1974 | De Lepeleire | 251/61 X |

*Primary Examiner*—Henry T. Klinksiek
*Attorney, Agent, or Firm*—McCormick, Paulding & Huber

[57] ABSTRACT

A conduit with inlet and discharge ends respectively for receiving a supply of air under pressure and for delivering the air at a lower pressure has a cylindrical configuration and an eliptical butterfly type damper is disposed diagonally therein. The damper turns about an axis intermediate its diagonally opposite ends and the oncoming air stream thus impinges on the upstream face of the damper on opposite sides of the axis and creates a differential force, the said differential force tending to close the damper and constituting a first closing force. A second closing force for the damper is provided by a small bellows supplied with air through a small conduit from the downstream side of an orifice member disposed in the main conduit upstream of the damper. A second and substantially larger bellows serves to open the damper and a small conduit connects the said bellows with a controller supplied with air from an upstream side of the orifice member in the main conduit. The controller regulates pressure in the large bellows as determined by a pressure drop signal across the orifice member and a thermostat. The thermostat vents air from the controller to reduce large bellows pressure for damper closing operation and, conversely, the large bellows is pressurized to cause the butterfly damper to move in the opening direction.

10 Claims, 11 Drawing Figures

SYSTEM POWERED ACTUATING MEANS FOR BUTTERFLY TYPE DAMPER

BACKGROUND OF THE INVENTION

System powered actuating means for butterfly and other dampers find increasing favor in air conditioning systems. Further, such actuating means have heretofor been designed to obviate the need for spring loaded butterfly dampers by employing velocity pressure derived actuating forces for closing the dampers. Such a damper is illustrated and described in U.S. Pat. No. 3,361,157 to Schach and actuating means of this type have been generally satisfactory. Certain disadvantages are encountered, however, in the use of velocity pressure to create a damper closing force. More particularly, it is necessary to limit the range of movement of the damper so that the damper is never permitted to completely close or completely open. Obviously, a damper which is not fully open creates an unnecessary and undesirable pressure drop at high flow conditions and, the inability to fully close the damper of course results in system leakage.

SUMMARY OF THE INVENTION

It is the general object of the present invention to provide a system powered actuating means for a butterfly type damper wherein a velocity pressure derived force is employed to close the damper, and wherein a second closing force is provided by a small bellows operating in opposition to a larger actuating or control bellows, the aforementioned disadvantages of limited range thus being overcome.

A more specific object of the invention resides in the provision of an actuating means with a small biasing bellows as mentioned above wherein the bellows is so designed and its air supply so connected as to provide a relatively high closing force to the damper when the requirement for such force is at a high level.

BRIEF DESCRIPTION OF THE PREFERRED EMBODIMENT

Figure 1:
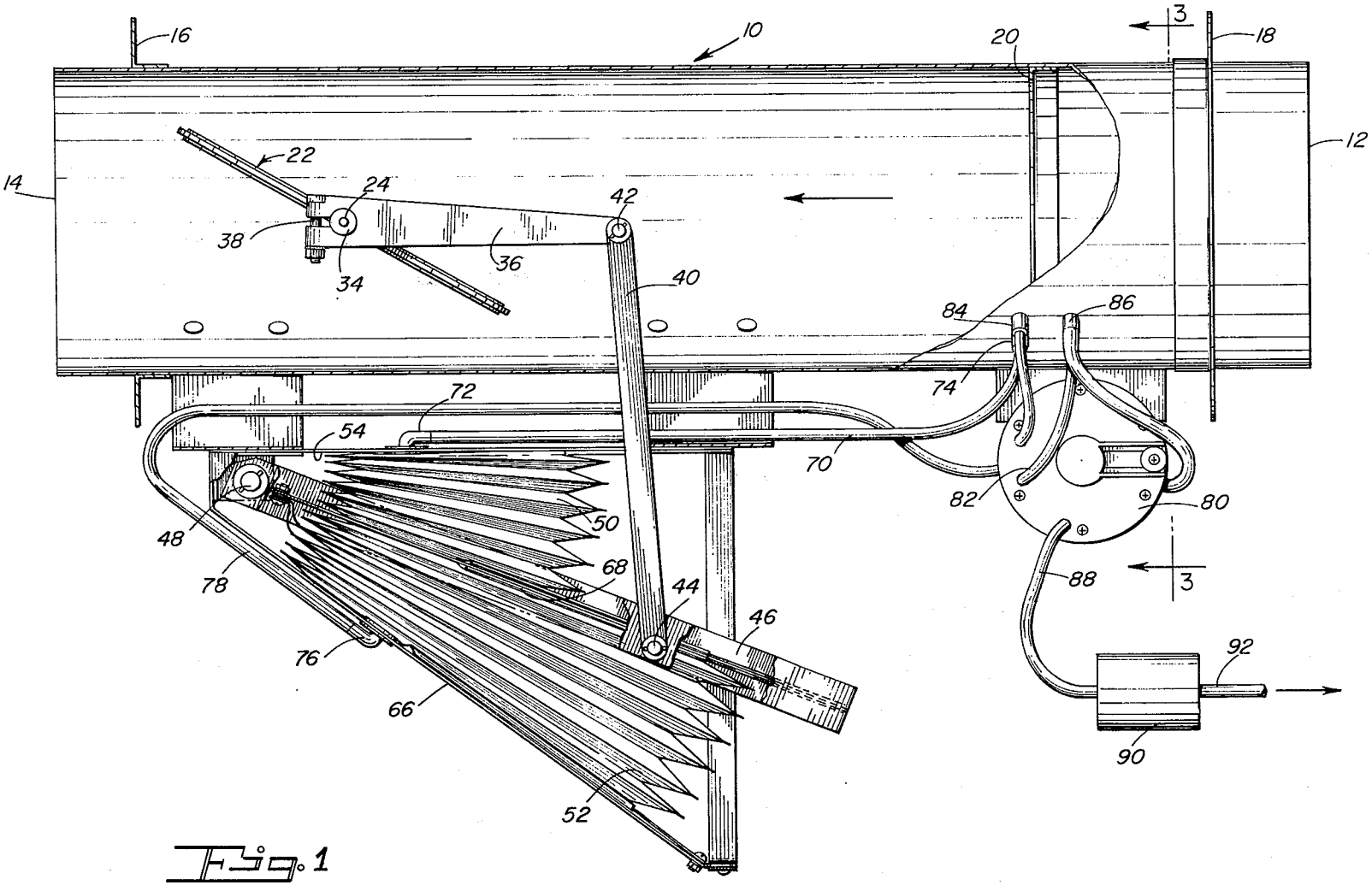
FIG. 1 is a top view of an air conduit, a butterfly type damper and actuating means constructed in accordance with the present invention, a portion of the conduit being broken away for clarity of illustration.
Figure 2:
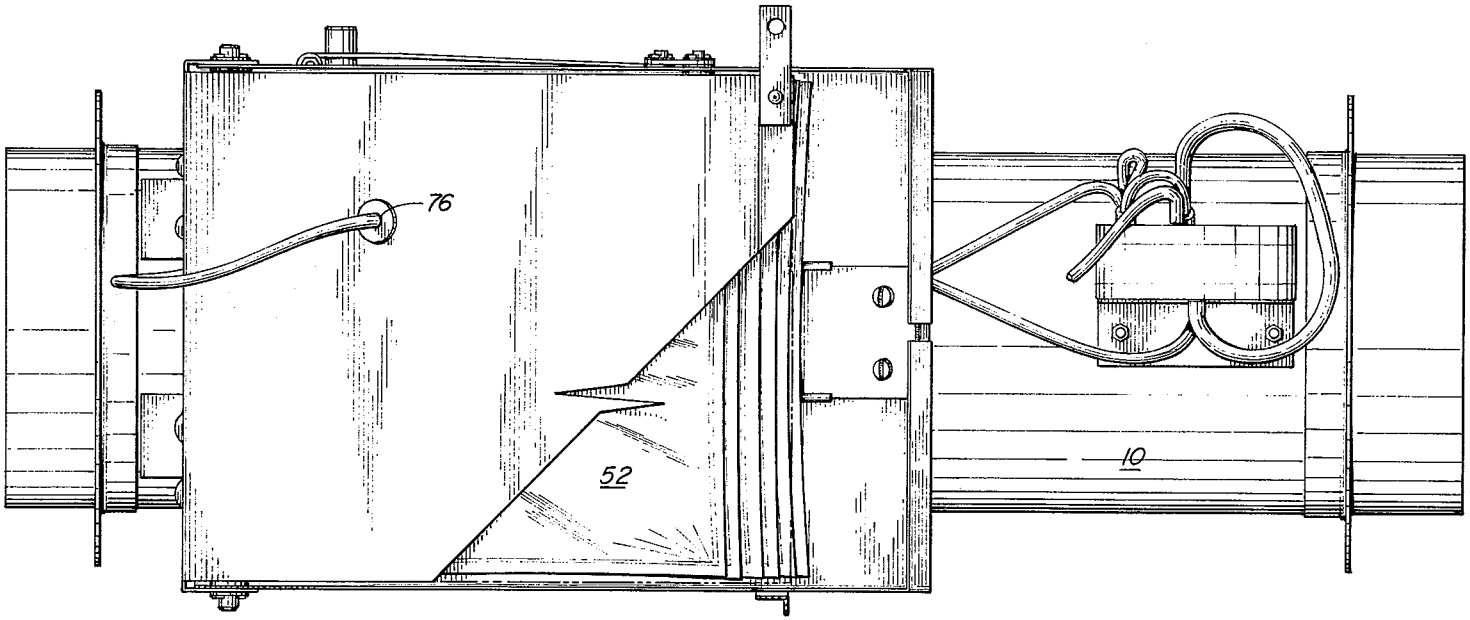
FIG. 2 is a side view of the elements shown in FIG. 1, a portion of a bellows seating member being broken away for clarity of illustration.

Referring particularly to FIG. 1, it will be observed that an air conduit 10 has inlet and discharge ends 12 and 14 respectively for receiving a supply of air under pressure and for delivering the air at a lower pressure toward an area of use. The conduit 10 may vary widely in form but as shown, is cylindrical in shape with left and right hand flanged mounting collars 16, 18. Disposed within the conduit adjacent a right hand end portion thereof is an orifice member 20 which has a reduced diameter to provide a cross-sectional area somewhat smaller than that of the conduit and to thus create a pressure drop thereacross.

Figure 11:
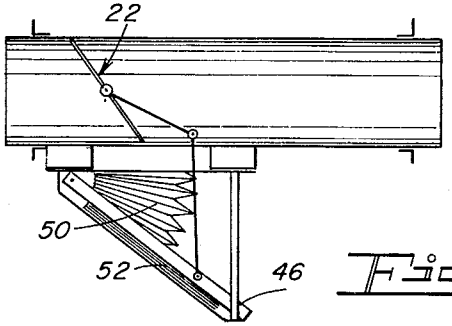
FIG. 11 is a schematic illustration showing the damper and actuating means for the damper in a fully closed position.
Figure 10:
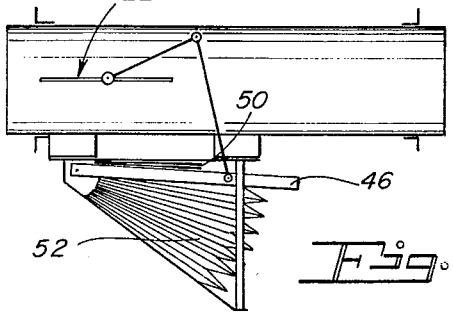
FIG. 10 is a schematic view showing the damper and actuating means for the damper in a fully open condition.

Disposed within the conduit 10 is a generally flat butterfly type damper 22 which turns about an axis 24 disposed intermediate opposite ends of the damper and which extends diametrically with respect to the conduit. The said opposite ends of the damper, in accordance with the present invention, have a substantially greater distance therebetween than the sides of the damper such that the damper is disposed diagonally of the conduit in its closed position, FIG. 11, and throughout its range of movement to its fully open position where it resides in the plane of the conduit axis as illustrated in FIG. 10. As is well-known, a butterfly type damper so arranged in a conduit is subject to the impingement of the oncoming airstream on opposite sides of its axis and a differential force is thus created, said force tending to close the damper and, in accordance with the present invention, constituting a first closing force. Reference may be had to the aforementioned patent for a further discussion of a velocity pressure derived closing force on a diagonally arranged butterfly damper. Such closing force terminates when the damper reaches a fully closed position and air flow over the damper edges ceases. Similarly, when the damper is in parallelism with the conduit axis in its fully open position, the velocity pressure derived force is ineffective.

Figure 3:
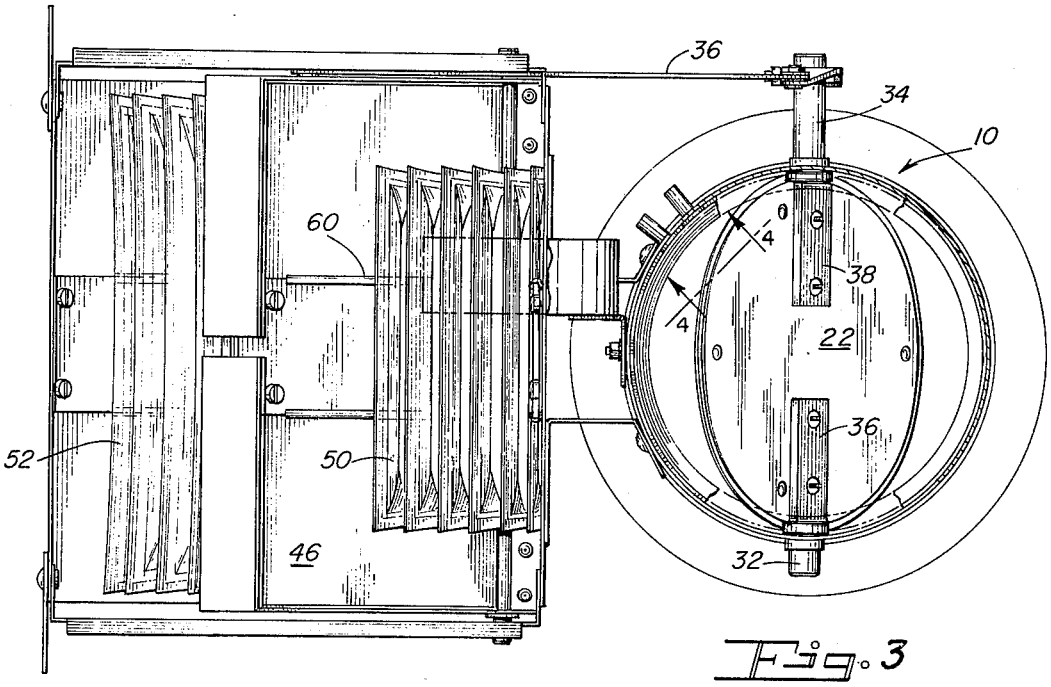
FIG. 3 is a sectional view taken generally as indicated at 3—3 in FIG. 1.
Figure 4:
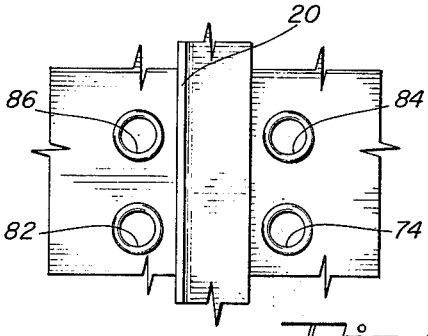
FIG. 4 is a fragmentary view illustrating pressure taps and a portion of an orifice member in the air conduit.
Figure 5:
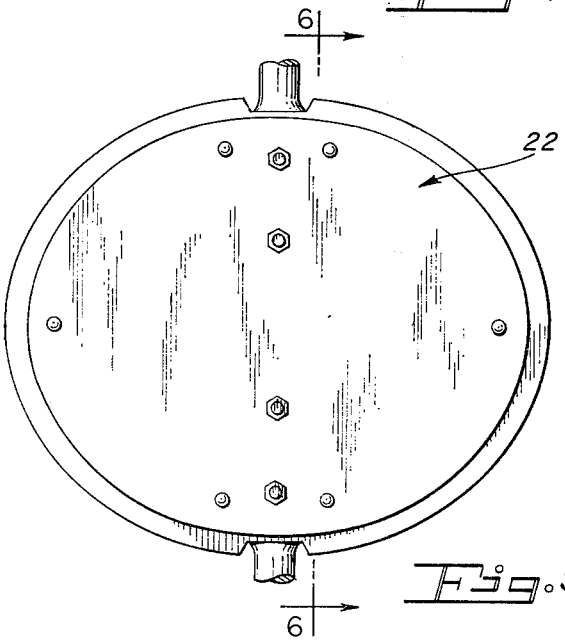
FIG. 5 is a fragmentary view illustrating the butterfly type damper in the air conduit.
Figure 6:
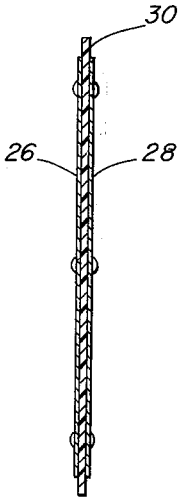
FIG. 6 is a sectional view through the damper of FIG. 5 and illustrating a preferred sandwich construction thereof.

The presently preferred construction of the damper 22, best illustrated in FIGS. 3, 5 and 6, is of the sandwich type with outer plates 26,28 riveted or otherwise attached to a resilient intermediate member 30 which projects outwardly beyond the members 26 and 28 for sealing action against the wall of the conduit 10. The butterfly damper takes an elliptical configuration in plan form as illustrated in FIG. 5 with the longer dimension of the ellipse extending diagonally in the conduit in FIG. 1. Short stub shafts 32, 34 respectively affixed to the damper by integral flat members 36, 38 project outwardly through appropriate openings in the conduit 10 and are adapted to rotate about the aforementioned axis 24. The stub shaft 34 is slightly longer than the stub shaft 32 and serves as a part of an actuating means for the damper 22 as described hereinbelow.

As best illustrated in FIGS. 1 and 3 the stub shaft 34 has an associated linkage means comprising a link 36 adjustably connected thereto at 38 and connected at an opposite end to a link 40. A small pivot pin 42 connects the links 36 and 40 and, at its opposite end, the link 40 has a pivot pin 44 connecting the same with a swingable bellows seating member 46. The member 46 is of generally flat construction and is pivoted at a small pin 48 so as to swing thereabout in clockwise and counterclockwise directions and to thereby urge the links 40, 36, and the butterfly damper 22 in one and opposite directions respectively to close and open the conduit 10.

Figure 7:
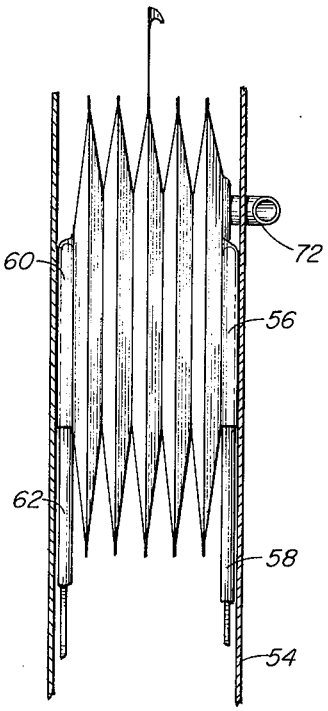
FIG. 7 is a side view of a small biasing bellows.
Figure 8:
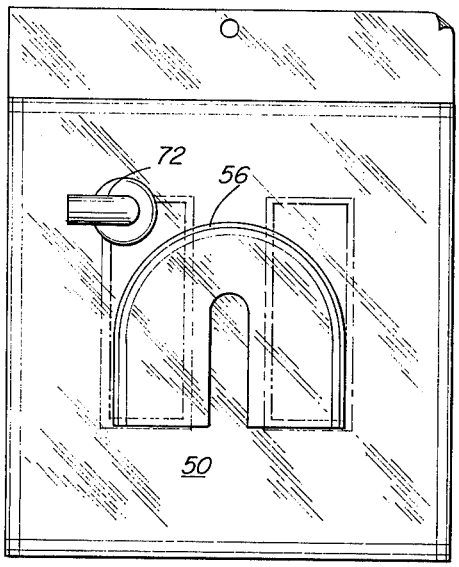
FIG. 8 is a plan view of the small biasing bellows mounted on its seating member.
Figure 9:
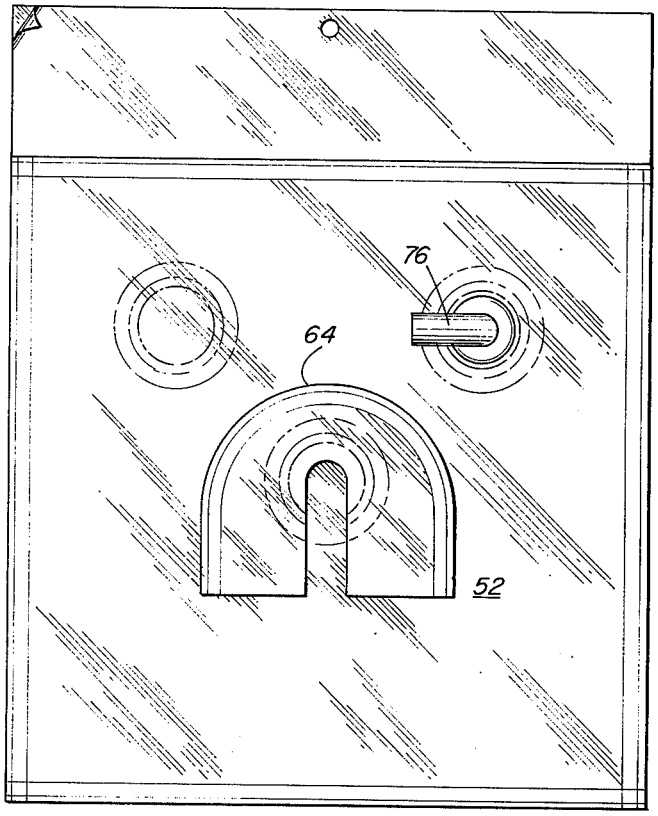
FIG. 9 is a plan view of a large bellows mounted on its seating member.

The swingable member 46 further serves as a seat for the movable ends of first and second bellows 50, 52, each of which is expansible and contractible. The bellows 50 has its fixed end secured to a generally flat member 54. As best illustrated in FIG. 8, the bellows is formed with a pocket 56 which is partially circular and which receives a similar partially circular flap 58, FIG. 7, mounted at one end on the plate 54. At its movable end, the bellows has a second pocket 60 receiving a second flap member 62 whereby to be secured in operative position between the members 54 and 46. The bellows 52 is similarly provided with a pocket 64 for receiving a flap member on a seating member 66 arranged generally in an V configuration with the member 54. The movable end of the bellows 52 has a pocket 68 receiving a similar flap member on the swingable member 46 opposite the bellows 50.

As will be apparent, the small bellows 50 urges the swingable member 46 in a clockwise direction thereby tending to close the damper 22 and the bellows 52 urges the member 46 in a counter-clockwise direction tending to open the damper 22. The small bellows 50 thus serves as a biasing means providing a second closing force on the damper 22 and has a pressure or effective area substantially smaller than the bellows 52. Preferably, the area of the small bellows is between one third and two thirds the pressure area of the large bellows. The large bellows 52 is an actuating or control bellows and control pressure therein is varied as described hereinbelow.

A first air passageway means in the form of a small conduit 70 communicates at a fitting 72 with the interior of the bellows 50 and, at an opposite end, a fitting 74 provides communication between the conduit 70 and the interior of the conduit 10 upstream of the damper 22. It should also be noted that the communication of the fitting 74 with the conduit 10 occurs downstream of the orifice member 20. This is the preferred form of the invention, and provides for a relatively high closing force on the damper 22 when it is most needed. That is, the aerodynamic or first closing force mentioned above is at a relatively low level when flow through the conduit 10 is at a low level with the damper 22 nearly closed. In this condition, the pressure drop across the orifice member 20 is minimal and the pressure available at the fitting 74 and thence to the bellows 50 is relatively high for effective and full closing of the damper. The use of a higher pressure source of supply for the bellows 50 would of course entail the use of an unnecessarily large control bellows 52. During high flow conditions with larger damper openings in the conduit 10, the aerodynamic force tending to close the damper 22 is substantially higher and the relatively large pressure drop then existing across the orifice member 20 is of little or no consequence as the closing force of the bellows 50 is not needed and may be at a minimum.

The actuator or control bellows 52 has a fitting 76 in communication with a small control conduit 78 extending to a controller 80, the said conduit constituting a second air passageway means. A third air passageway means takes the form of a small supply conduit 82 extending from the controller 80 to air conduit 10 and communicating therewith on the upstream side of the orifice member 20. The conduit 82 at its entrance to air conduit 10 may also include a pitot tube, not shown, so as to provide for a total pressure pick-up upstream of the orifice member 20. Conduits 84 and 86 respectively communicate with the air conduit 10 on downstream and upstream sides of the orifice member 20 and extend therefrom to the controller 80 whereby to provide a pressure differential or pressure drop signal in a conventional manner. Extending from the controller 80 is a small conduit 88 which communicates with a thermostat 90 operable to vent air from the controller to atmosphere at 92.

As indicated, the controller 80 may be of a conventional type found in air conditioning systems using conventional damper actuating means, as for example in the aforementioned patent. Further, the thermostat 90 may be of a conventional type adapted to vent air under pressure to atmosphere when a reduced cooling requirement prevails, thus reducing pressure in the bellows 52 through the controller 80 and the control conduit 78 and allowing the damper 22 to move in the closing direction. When the thermostat 90 calls for additional cooling, the thermostat operates to terminate the venting of air under pressure at 92 and thus, through the controller 80 and the conduit 78 to pressurize the bellows 52 and to further open the damper 22. At a thermostat setting for full cooling, the controller senses the pressure drop across the orifice number 20 and if the drop is higher than a preset drop in the controller air is vented from the large bellows. If the pressure drop across the orifice member is low as compared with a presetting in the controller, the large bellows is inflated to further open the damper 22. In this manner, and under a requirement for full cooling, the controller can limit the maximum flow through the conduit 10 to within a few per cent of a designed flow setting despite duct pressure variation of several inches of water.

From the foregoing, it will be apparent that temperature and other control functions can be readily achieved with the actuating means of the present invention. For example, a constant flow or volume control system can be provided merely by eliminating the thermostatic means described above and balancing a measured pressure drop against a preset pressure drop. Similarly, a constant static pressure control can be provided as in the aforementioned patent merely by balancing a measured static pressure against a preset pressure and venting air from the control bellows as required. In each such system, positive closing action of the damper is provided for by the second closing force of the small bellows 50. There is no need to maintain a slightly open position of the damper in its "closed" position nor is there a requirement that the damper be prevented from assuming a full open position in alignment with the axis of the air conduit. Still further, there is no requirement for a specific arrangement of actuating means as in the aforementioned patent in order to derive a gravity closing force. The axis 24 of the damper 22 is preferably positioned in a vertical plane but no stringent requirements of axis attitude are encountered. Finally, it is to be noted that a most effective damper closing action of the small bellows 50 is achieved at precisely the desired point in damper operation, e.g., at a low flow condition with the damper approaching its fully closed position.

We claim:

1. The combination comprising:

a. a conduit having inlet and discharge ends respectively for receiving a supply of air under pressure and for delivering the air at a lower pressure toward an area of use, b. a butterfly type damper disposed in said conduit and mounted to turn about an axis disposed intermediate opposite ends of the damper and extending diametrically of the conduit, c. the said opposite ends of the damper having a substantially greater distance therebetween than the sides of the damper and the damper thus being disposed diagonally of the conduit in its closed position whereby impingement of the oncoming air stream on opposite sides of said axis creates a differential force, said force tending to close the damper and constituting a first closing force, d. a first expansible and contractible bellows of small pressure area having one wall fixed and a second wall movable and connected with said damper to provide a second damper closing force, e. first air passageway means connecting the interior of said bellows with said conduit upstream of said damper for a supply of air under pressure to said bellows, f. a second expansible and contractible bellows substantially larger in pressure area than said first bellows and having one wall fixed and a second wall movable in opposition to said first bellows and connected with said damper to provide a damper opening force, g. second air passageway means connected with said second bellows, h. a controller connected with said second air passageway means and operable to control air pressure in said second bellows and thereby to control damper position, i. and third air passageway means connected between said controller and said conduit upstream of said damper for a supply of air under pressure to said bellows.

2. The combination as set forth in claim 1 wherein the pressure area of said small bellows is between one-half and three-fourths the pressure area of the large bellows.

3. The combination as set forth in claim 1 wherein said conduit is cylindrical and wherein said damper takes an elliptical configuration, the longer dimension of the elipse extending diagonally in the conduit with the damper in a closed position.

4. The combination as set forth in claim 1 wherein an orifice member is provided in said conduit upstream of said damper, said member having a cross-sectional area less than the cross-sectional area of the conduit whereby to provide for a pressure drop thereacross.

5. The combination as set forth in claim 4 wherein said first air passageway means is connected with said conduit between said damper and said orifice member.

6. The combination as set forth in claim 4 wherein said third air passageway means is connected with said conduit on the upstream side of said orifice member.

7. The combination as set forth in claim 5 wherein said third air passageway means is connected with said conduit on an upstream side of said orifice member and comprises a total pressure pick-up.

8. The combination as set forth in claim 7 and including thermostatic means operatively connected with said controller and serving to vent air therefrom and from said second bellows through said second air passageway means whereby to control the pressure in said bellows and the position of said damper.

9. The combination as set forth in claim 8 wherein fourth and fifth passageway means are connected with said controller and with said conduit respectively on upstream and downstream sides of said orifice member whereby to provide a pressure drop signal to the controller, and wherein said thermostatic means operates in opposition to said pressure drop signal to control pressure in said second bellows and thus to maintain temperature control.

10. The combination as set forth in claim 7 wherein a swingable member is provided for connection between the movable sides of said first and second bellows, and wherein linkage means is provided between said swingable member and said damper for positioning the latter under the control of said first and second bellows.

* * * * *